US009341179B2

(12) United States Patent
Ochoa et al.

(10) Patent No.: US 9,341,179 B2
(45) Date of Patent: May 17, 2016

(54) PRECOMPRESSION EFFECT IN PUMP BODY

(75) Inventors: Brian Ochoa, Hanover (DE); Philippe Gambier, La Defense (FR); Aude Faugere, Houston, TX (US); Christopher Shen, Houston, TX (US); Joe Hubenschmidt, Sugar Land, TX (US); Tze Wei Chua, Stafford, TX (US); Walter Taylor, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1015 days.

(21) Appl. No.: 13/032,959

(22) Filed: Feb. 23, 2011

(65) Prior Publication Data

US 2012/0213651 A1 Aug. 23, 2012

Related U.S. Application Data

(60) Provisional application No. 61/308,723, filed on Feb. 26, 2010.

(51) Int. Cl.

| | |
|---|---|
| ***F01B 11/02*** | (2006.01) |
| ***F04B 53/00*** | (2006.01) |
| ***F04B 53/16*** | (2006.01) |

(52) U.S. Cl.

CPC ..... *F04B 53/007* (2013.01); *F04B 53/16* (2013.01); *F04B 53/162* (2013.01); *F05C 2201/0448* (2013.01); *F05C 2253/12* (2013.01); *Y10T 29/49249* (2015.01)

(58) Field of Classification Search

CPC ..... F04B 53/007; F04B 53/16; F04B 53/162

USPC ..... 92/169.1, 169.2, 170.1

See application file for complete search history.

(56) References Cited

U.S. PATENT DOCUMENTS

| | | | | |
|---|---|---|---|---|
| 4,388,050 | A | 6/1983 | Schuller | |
| 4,577,549 | A * | 3/1986 | Frank et al. | 92/169.1 |
| 5,024,116 | A * | 6/1991 | Kraft | 74/109 |
| 6,382,940 | B1 | 5/2002 | Blume | |
| 6,419,459 | B1 | 7/2002 | Sibbing | |
| 6,463,843 | B2 * | 10/2002 | Pippert | 92/170.1 |
| 6,910,871 | B1 | 6/2005 | Blume | |
| 7,186,097 | B1 | 3/2007 | Blume | |
| 7,354,256 | B1 | 4/2008 | Cummins | |
| 7,484,452 | B2 | 2/2009 | Baxter et al. | |

(Continued)

FOREIGN PATENT DOCUMENTS

WO 2011027273 A2 3/2011

OTHER PUBLICATIONS

Parylene Engineering, "Use of Parylene Coatings", 2010, Retrieved from the Internet<URL:http://www.paryleneengineering.com/why_use_parylene.html>.*

(Continued)

*Primary Examiner* — Nathaniel Wiehe
*Assistant Examiner* — Daniel Collins
(74) *Attorney, Agent, or Firm* — Michael L. Flynn; Rachel E. Greene; Tim Curington

(57) ABSTRACT

The current application discloses various embodiments where a portion of a fluid end pump body is made of a first material the other parts of the pump body are made of a second material where the first material is a material having better resistance to fatigue and the second material used is a material of less quality and cheaper than the first material.

14 Claims, 2 Drawing Sheets

(56) References Cited

U.S. PATENT DOCUMENTS

| | | | |
|---|---|---|---|
| 7,513,759 | B1 | 4/2009 | Blume |
| 2003/0235508 | A1 | 12/2003 | Vicars |
| 2008/0000065 | A1 | 1/2008 | Ganguly et al. |
| 2008/0138224 | A1 | 6/2008 | Vicars |
| 2009/0081034 | A1 | 3/2009 | Gambier et al. |
| 2009/0092510 | A1 | 4/2009 | Williams et al. |

OTHER PUBLICATIONS

Stephanie Steward, Flame-Spray Unity Applies PEEK Coatings, MPMN Mar. 2009 .Retrieved from the Internet <URL:http://www.qmed.com/mpmn/article/flame-spray-unit-applies-peek-coatings.html.*

Varschaysky, A, The Cylic Stress Behavious of a 344 Stainless Steel 2024-T8 Alluminum Alloy, Journal of Materials Science 4 (1969) 653-657.*

Harris, Stephen, Tribology of metal-containing diamond-like carbon Coatings, Wear 211 (1997) 208-217.*

MSI X-treme Service Brochure, Unknown date.

Halliburton, "Cementing HT-400 Pump", Halliburton Brochure, H04798, Apr. 2006, 2 pages.

* cited by examiner

PRECOMPRESSION EFFECT IN PUMP BODY

RELATED APPLICATION DATA

This application claims priority of U.S. Provisional Patent Application Ser. No. 61/308,723 filed Feb. 26, 2010, which is incorporated by reference herein.

BACKGROUND

The statements in this section merely provide background information related to the present disclosure and may not constitute prior art. All references discussed herein, including patent and non-patent literatures, are incorporated by reference into the current application.

The invention is related in general to wellsite surface equipment such as fracturing pumps and the like. Hydraulic fracturing of downhole formations is a critical activity for well stimulation and/or well servicing operations. Typically this is done by pumping fluid downhole at relatively high pressures so as to fracture the rocks. Oil can then migrate to the wellbore through these fractures and significantly enhance well productivity.

Multiplex reciprocating pumps are generally used to pump high pressure fracturing fluids downhole. Typically, the pumps that are used for this purpose have plunger sizes varying from about 9.5 cm (3.75 in.) to about 16.5 cm (6.5 in.) in diameter. These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. Similarly, a quintuplex pump has five fluid cylinders, including a middle cylinder and four side cylinders. A fluid end may comprise a single block having cylinders bored therein, known in the art as a monoblock fluid end.

The pumping cycle of the fluid end typically is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2 Ksi) to as high as 145 MPa (21 Ksi)) the discharge valve opens, and the high pressure fluid flows through the discharge pipe.

Given a pumping frequency of 2 Hz, i.e., 2 pressure cycles per second, the fluid end body can experience a very large number of stress cycles within a relatively short operational lifespan. These stress cycles may induce fatigue failure of the fluid end. Fatigue involves a failure process where small cracks initiate at the free surface of a component under cyclic stress. The cracks may grow at a rate defined by the cyclic stress and the material properties until they are large enough to warrant failure of the component. Since fatigue cracks generally initiate at the surface, a strategy to counter such failure mechanism is to pre-load the surface.

Typically, this is done through an autofrettage process, which involves a mechanical pre-treatment of the fluid end in order to induce residual stresses at the internal free surfaces, i.e., the surfaces that are exposed to the fracturing fluid, also known as the fluid end cylinders. US 2008/000065 is an example of an autofrettage process for pretreating the fluid end cylinders of a multiplex pump. During autofrettage, the fluid end cylinders are exposed to high hydrostatic pressures. The pressure during autofrettage causes plastic yielding of the inner surfaces of the cylinder walls. Since the stress level decays across the wall thickness, the deformation of the outer surfaces of the walls is still elastic. When the hydrostatic pressure is removed, the outer surfaces of the walls tend to revert to their original configuration. However, the plastically deformed inner surfaces of the same walls constrain this deformation. As a result, the inner surfaces of the walls of the cylinders inherit a residual compressive stress. The effectiveness of the autofrettage process depends on the extent of the residual stress on the inner walls and their magnitude.

Co-pending and co-assigned US Patent Application Publication US2009/0081034 discloses a piece of oilfield equipment such as a pump that includes a base material less subject to abrasion, corrosion, erosion and/or wet fatigue than conventional oilfield equipment materials such as carbon steel and a reinforcing composite material for adding stress resistance and reduced weight to the oilfield equipment.

It remains desirable to provide improvements in wellsite surface equipment in efficiency, flexibility, reliability, and maintainability.

SUMMARY

In one aspect of the current application, there is provided a fluid end of a pump and the fluid end comprises a piston bore, an inlet bore, an outlet bore; where at least a portion of a pump body is made of a first material and the other parts of the pump body are made of a second material. In some cases, the first material is a material having better resistance to fatigue, such as stainless steel. In some cases, the first material is a layer of coating selected from the group consisting of plasma coating, chemical vapor deposition, physical vapor deposition, sputtering, and diamond-like coating. In some cases, the second material used is a material of less quality and cheaper than the first material such as an alloy steel.

In one embodiment, the portion of the pump body that is made of a first material is areas of the pump body adjacent the intersection of the piston pore, inlet bore, and the outlet bore. In one case, the portion of the pump body that is made of a first material is a recess near the piston bore. In another case, the portion of the pump body that is made of a first material is a recess near the inlet bore. In a further case, the portion of the pump body that is made of a first material is a recess near the outlet bore.

According to another aspect of the application, there is provided a method of reducing fatigues of a fluid end of a pump. The method comprises providing a fluid end comprising a piston bore, an inlet bore, and an outlet bore; and constructing a portion of a pump body in a first material and the other parts of the pump body in a second material. In some cases, the first material is a material having better resistance to fatigue such as stainless steel. In some cases, the first material is a layer of coating selected from the group consisting of plasma coating, chemical vapor deposition, physical vapor deposition, sputtering, and diamond-like coating. In some cases, the second material used is a material of less quality and cheaper than the first material, such as an alloy steel.

According to a further aspect of the application, there is provided an assembly comprising a plurality of pump bodies each defining a piston bore, an inlet bore, and an outlet bore, and a plurality of fasteners connecting the pump bodies and end plates to form the pump assembly, where at least a portion of a pump body is made of a first material and the other parts of the pump body are made of a second material, and the first material is a material having better resistance to fatigue. In one embodiment, the portion of the pump body that is made of a first material is selected from the group consisting of (a) areas of the pump body adjacent the intersection of the piston pore, inlet bore, and the outlet bore; (b) a recess near the piston bore; (c) a recess near the inlet bore.

DETAILED DESCRIPTION OF EMBODIMENTS OF APPLICATION

Figure 1:
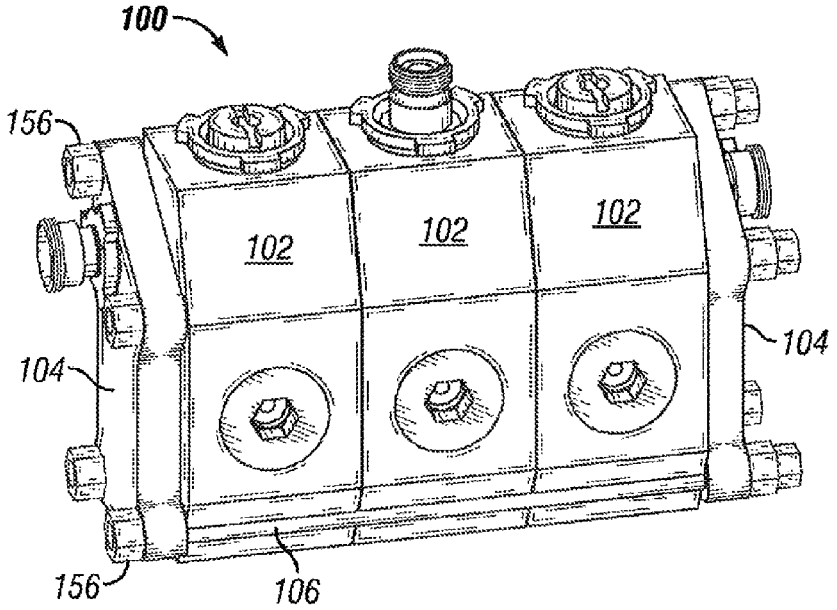
FIG. 1 is a perspective view of the fluid end of a triplex pump assembly according to an embodiment of the application.
Figure 2:
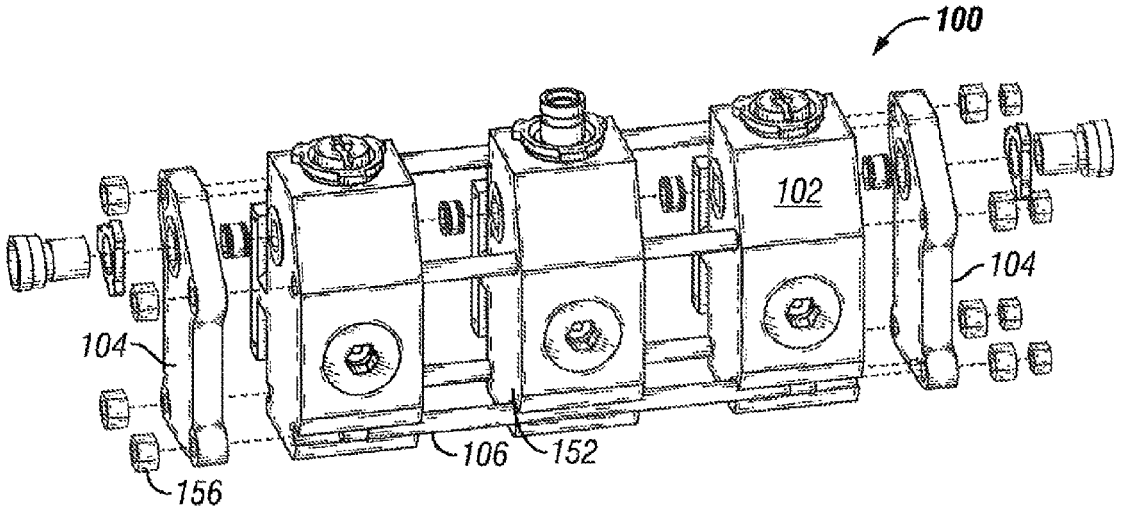
FIG. 2 is an exploded view of the triplex pump assembly of FIG. 1 according to an embodiment of the application.

FIGS. 1-2 show the fluid end of the multiplex pump 100 including a plurality of pump bodies 102 secured between end plates 104 by means of fasteners, which in one case comprise one or more tie rods 106 and one or more threaded nuts 156. The end plates 104 are utilized in conjunction with the fasteners 106 to assemble the pump bodies 102 to form the pump 100. When the pump 100 is assembled, the three pump bodies 102 are assembled together using, for example, four large fasteners or tie rods 106 and the end plates 104 on opposing ends of the pump bodies 102. At least one of the tie rods 106 may extend through the pump bodies 102, while the other of the tie rods 106 may be external of the pump bodies 102. In addition to the triplex configuration of pump 100, those skilled in the art will appreciate that the pump bodies 102 may also be arranged in other configurations, such as a quintuplex pump assembly comprising five pump bodies 102, or the like.

Figure 4:
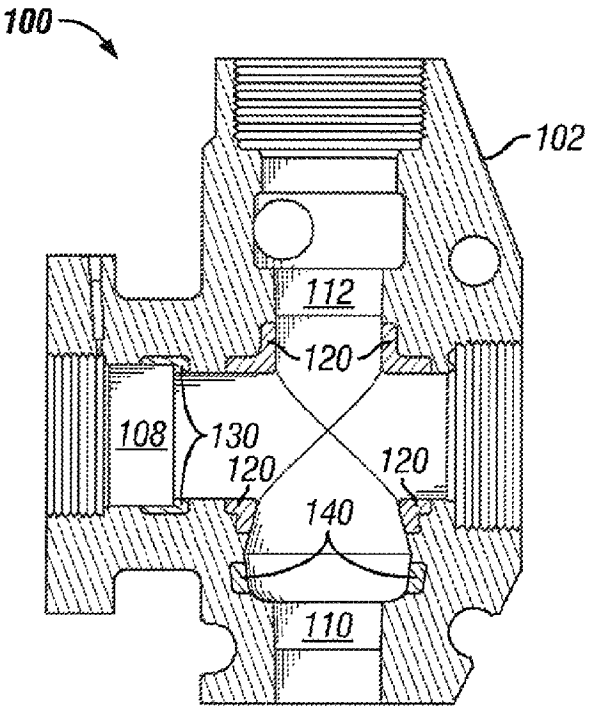
FIG. 4 is a side sectional view of the pump body of FIG. 3 as seen along the lines 4-4 according to an embodiment of the application.
Figure 3:
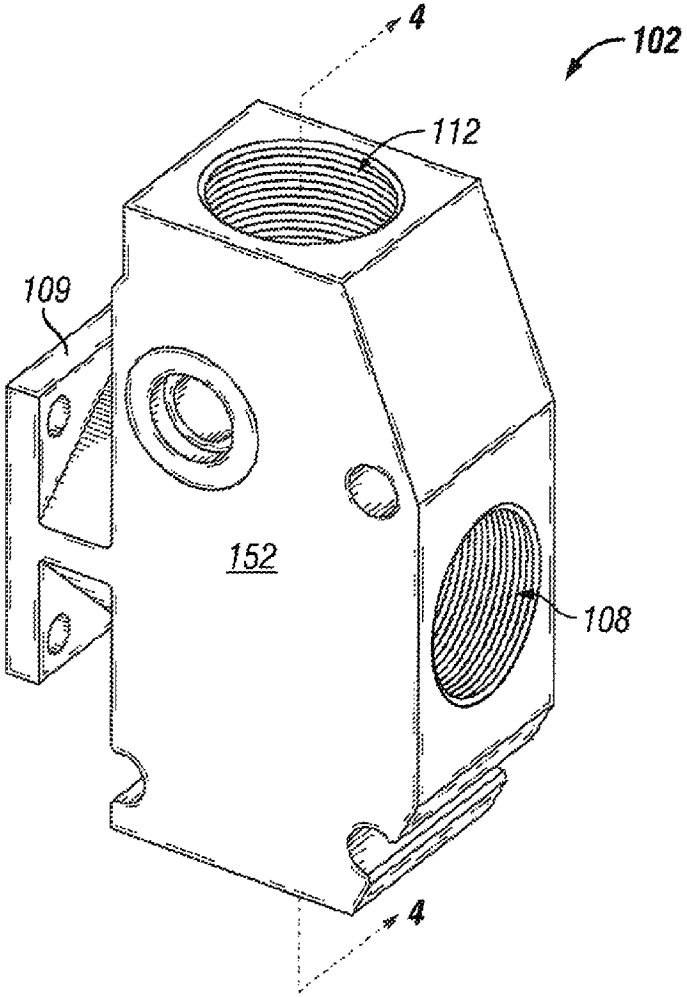
FIG. 3 is a perspective view of one of the pump body of the triplex pump assembly of FIGS. 1-2 according to an embodiment of the application.

As best seen in FIGS. 3-4, the pump body 102 has an internal passage or piston bore 108 which may be a through bore for receiving a pump plunger through the fluid end connection block 109. The connection block 109 provides a flange that may extend from the pump body 102 for guiding and attaching a power end to the pistons in the pump 100 and ultimately to a prime mover, such as a diesel engine or the like, as will be appreciated by those skilled in the art.

The pump body 102 may further define an inlet port 110 opposite an outlet port 112 substantially perpendicular to the piston bore 108, forming a crossbore. The bores 108, 110, and 112 of the pump body 102 may define substantially similar internal geometry as prior art monoblock fluid ends to provide similar volumetric performance. Those skilled in the art will appreciate that the pump body 100 may comprise bores formed in other configurations such as a T-shape, Y-shape, in-line, or other configurations.

According to one aspect of the embodiments disclosed herewith, different materials are used for construction of the pump body. In a first embodiment, the pump body 102 is entirely made of stainless steel material. Prior art systems were made in alloy steel. Stainless steel material has better physical properties than alloy steel. In one embodiment, autofrettage process is not necessarily done on the stainless steel material because the material has enough resistant to fatigue without need of autofrettage process. In a second embodiment, areas 120 of the pump body 102 adjacent the intersection of the bores 108, 110, and 112 are made of a first material and the other parts of the pump body 102 are made of a second material. The first material is preferably a material having better resistance to fatigue. In one case, the first material can be stainless steel, the second material can be alloy steel. In another case, the first material can be a coating (plasma coating, chemical vapor deposition, physical vapor deposition, sputtering, diamond-like coating), a supplemental piece of material. The first material can have a small or large thickness. The second material used can be a material of less quality and cheaper than the first material.

In a third embodiment, areas 130 (recess near the piston bore 108) of the pump body 102 are made of a third material and the other parts of the pump body 102 are made of a second material. The third material is preferably a material having better resistance to fatigue. The second material used can be a material of less quality and cheaper than the first material. In one case, the third material can be stainless steel, the second material can be alloy steel. In another case, the third material can be a coating (plasma coating, chemical vapor deposition, physical vapor deposition, sputtering, diamond-like coating), a supplemental piece of material. The third material can have a small or large thickness.

In a fourth embodiment, areas 140 (recess near the inlet bore 110) of the pump body 102 are made of a fourth material and the other parts of the pump body 102 are made of a second material. The fourth material is preferably a material having better resistance to fatigue. The second material used can be a material of less quality and cheaper than the first material. In one case, the fourth material can be stainless steel, the second material can be alloy steel. In another case, the fourth material can be a coating (plasma coating, chemical vapor deposition, physical vapor deposition, sputtering, diamond-like coating), a supplemental piece of material. The fourth material can have a small or large thickness.

In a fifth embodiment, any areas of the pump body portions subject to extensive fatigue or wear are made of a fifth material and the other parts of the pump body are made of a second material. The fifth material is preferably a material having better resistance to fatigue. The second material used can be a material of less quality and cheaper than the first material. The fifth material can be stainless steel, the second material can be alloy steel. The fifth material can be a coating (plasma coating, chemical vapor deposition, physical vapor deposition, sputtering, diamond-like coating), a supplemental piece of material. The fifth material can have a small or large thickness.

Due to the substantially identical profiles of the plurality of pump body 102, the pump body 102 may be advantageously interchanged between the middle and side portions of the assembly 100, providing advantages in assembly, disassembly, and maintenance, as will be appreciated by those skilled in the art. In operation, if one of the pump bodies 102 of the assembly 100 fails, only the failed one of the pump bodies 102 need be replaced, reducing the potential overall downtime of a pump assembly 100 and its associated monetary impact. The pump body 102 is smaller than a typical monoblock fluid end having a single body with a plurality of cylinder bores machined therein and therefore provides greater ease of manufacturability due to the reduced size of forging, castings, etc.

While illustrated as comprising three of the pump bodies 102, the pump 100 may be formed in different configurations, such as by separating or segmenting each of the pump bodies 102 further, by segmenting each of the pump bodies 102 in equal halves along an axis that is substantially perpendicular to the surfaces 152, or by any suitable segmentation.

The preceding description has been presented with reference to some illustrative embodiments of the Inventors' concept. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A fluid end of a pump, said fluid end comprising:

a pump body having a piston bore, an inlet bore, and an outlet bore;

wherein at least a portion of the pump body is made of a first material and the other parts of the pump body are made of a second material comprising an alloy steel;

wherein the first material has better resistance to fatigue than the second material, and wherein the second material is located on parts of the pump body that are in contact with fluids during operation of the pump.

2. The fluid end of claim 1, wherein the first material is stainless steel.

3. The fluid end of claim 1, wherein the first material is a layer of coating selected from the group consisting of plasma coating, chemical vapor deposition, physical vapor deposition, sputtering, and diamond-like coating.

4. The fluid end of claim 1, wherein the portion of the pump body that is made of the first material is in areas of the pump body adjacent the intersection of the piston bore, the inlet bore, and the outlet bore, and wherein the second material is located in areas of the pump body which are not adjacent the intersection of the piston bore, the inlet bore, and the outlet bore.

5. The fluid end of claim 1, wherein the portion of the pump body that is made of the first material is in a recess near the piston bore, and wherein the second material is located in areas of the pump body which are not in the recess near the piston bore.

6. The fluid end of claim 1, wherein the portion of the pump body that is made of the first material is in a recess near the inlet bore, and wherein the second material is located in areas of the pump body which are not in the recess near the inlet bore.

7. A method of reducing fatigues of a fluid end of a pump, said method comprising:

utilizing a fluid end comprising a pump body having a piston bore, an inlet bore, and an outlet bore; and constructing a portion of the pump body in a first material and the other parts of the pump body in a second material comprising an alloy steel; and wherein the first material has better resistance to fatigue than the second material, wherein the second material is located on parts of the pump body that are in contact with fluids during operation of the pump.

8. The method of claim 7, wherein the first material is stainless steel.

9. The method of claim 7, wherein the first material is a layer of coating selected from the group consisting of plasma coating, chemical vapor deposition, physical vapor deposition, sputtering, and diamond-like coating.

10. The method of claim 7, wherein the portion of the pump body that is made of the first material is in areas of the pump body adjacent the intersection of the piston bore, the inlet bore, and the outlet bore, and wherein the second material is located in areas of the pump body which are not adjacent the intersection of the piston bore, the inlet bore, and the outlet bore.

11. The method of claim 7, wherein the portion of the pump body that is made of the first material is in a recess near the piston bore, and wherein the second material is located in areas of the pump body which are not in the recess near the piston bore.

12. The method of claim 7, wherein the portion of the pump body that is made of the first material is in a recess near the inlet bore, and wherein the second material is located in areas of the pump body which are not in the recess near the inlet bore.

13. A pump assembly comprising:

a plurality of pump bodies each defining a piston bore, an inlet bore, and an outlet bore;

a plurality of fasteners connecting the pump bodies and end plates to form the pump assembly;

wherein at least a portion of each of the pump bodies is made of a first material and the other parts of each of the pump bodies are made of a second material comprising an alloy steel, and wherein the first material has a better resistance to fatigue than the second material, and wherein the second material is located on parts of the pump body that are in contact with fluids during operation of the pump.

14. The pump assembly of claim 13, where the portion of the pump body that is made of the first material is in areas selected from the group consisting of (a) the pump body adjacent the intersection of the piston bore, the inlet bore, and the outlet bore; (b) a recess near the piston bore; (c) a recess near the inlet bore; and (d) combinations thereof.

* * * * *